US009199253B2

(12) United States Patent
Zhou et al.

(10) Patent No.: US 9,199,253 B2
(45) Date of Patent: Dec. 1, 2015

(54) MULTI-LEVEL WATERWAY CONTROL DEVICE

(75) Inventors: Huasong Zhou, Xiamen (CN); Shuiyuan Luo, Xiamen (CN); Jianmin Chen, Xiamen (CN); Bin Chen, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 523 days.

(21) Appl. No.: 13/641,787

(22) PCT Filed: Apr. 12, 2011

(86) PCT No.: PCT/CN2011/072638

§ 371 (c)(1),
(2), (4) Date: Oct. 17, 2012

(87) PCT Pub. No.: WO2011/131095

PCT Pub. Date: Oct. 27, 2011

(65) Prior Publication Data

US 2013/0025722 A1 Jan. 31, 2013

(30) Foreign Application Priority Data

Apr. 19, 2010 (CN) ..... 2010 1 0150296
Apr. 19, 2010 (CN) ..... 2010 2 0163115 U

(51) Int. Cl.
*B05B 1/18* (2006.01)
*B05B 1/16* (2006.01)
*B05B 1/30* (2006.01)

(52) U.S. Cl.
CPC ..... *B05B 1/18* (2013.01); *B05B 1/1681* (2013.01); *B05B 1/3026* (2013.01); *B05B 1/1636* (2013.01); *Y10T 137/86493* (2015.04)

(58) Field of Classification Search
CPC ..... B05B 1/18; B05B 1/1681; B05B 1/3026; B05B 1/1636; Y10T 137/86493
USPC ..... 137/625.46, 635, 636, 636.2, 625.31; 251/228, 229, 297, 79–81; 239/581.1, 239/581.2, 582.1, 583
See application file for complete search history.

(56) References Cited

U.S. PATENT DOCUMENTS 1,861,442 A * 6/1932 Hammerstein ..... 222/514
3,987,819 A * 10/1976 Scheuermann ..... 137/637.3

(Continued)

FOREIGN PATENT DOCUMENTS

CN 1626859 A 6/2005
CN 201172016 Y 12/2008

(Continued)

*Primary Examiner* — John K Fristoe, Jr.
*Assistant Examiner* — Josephine Trinidad-Borges
(74) *Attorney, Agent, or Firm* — Rabin & Berdo, P.C.

(57) ABSTRACT

A multi-level waterway control device has: a fixed unit, a flow regulating plate, a function switching plate and a drive unit. Flow regulation is achieved through the relative rotation between the flow regulating plate and the fixed unit. The outlet functions switch is achieved through the relative rotation between the function switching plate and the fixed unit. The drive unit can slide and rotate relative to the fixed unit, at least happen between the first and second position. When the drive unit is at the first position, it can form a synchronous rotation connection with the flow regulating plate, and the drive unit can drive the rotation of the flow regulating plate to achieve flow regulation. In the second position, the drive unit can form a synchronous rotation connection with the function switching plate, can drive the rotation of the function switching plate to achieve outlet functions switch.

15 Claims, 12 Drawing Sheets

(56) References Cited

U.S. PATENT DOCUMENTS

| | | | | |
|---|---|---|---|---|
| 4,151,957 | A | 5/1979 | Gecewicz et al. | |
| 2001/0023901 | A1 | 9/2001 | Haverstraw et al. | |
| 2006/0037656 | A1 * | 2/2006 | Golan et al. | 137/625.46 |
| 2007/0252022 | A1 | 11/2007 | Benstead | |

FOREIGN PATENT DOCUMENTS

| | | | |
|---|---|---|---|
| CN | 101799084 | A | 8/2010 |
| CN | 201651426 | U | 11/2010 |
| DE | 2843666 | A1 | 4/1980 |

* cited by examiner

MULTI-LEVEL WATERWAY CONTROL DEVICE

FIELD OF THE INVENTION

The present invention relates to a waterway control device used in bath equipment, more particularly to a multi-level waterway control device.

BACKGROUND OF THE INVENTION

Rotational switching which is traditionally used in the waterway control device of bath equipment comprises a fixed unit and a control plate rotationally arranged in the fixed unit. Outlet hole is opened on the control plate, and the fixed unit is provided with multiple outlet functions, and each outlet function is provided with a water division hole, and the communication between the water division hole and the outlet hole can be achieved by the relative rotation between the control plate and the fixed unit, and then the outlet function switch is achieved. According to the description above, the traditional waterway control device is only provided with outlet functions switch and without flow regulation. Aimed at the defects present in the traditional waterway control device, a solution is provided, which is arranged with functions switch and flow regulation. But the functions switch and the flow regulation are arranged and operated in different area respectively, the structure is complicated with large space occupation and inconvenient operation.

SUMMARY OF THE INVENTION

The object of the present invention is to offer a multi-level waterway control device, which overcomes the defect of the waterway control device at the prior art that only is provided with outlet function switch.

The technical proposal in the present invention to solve the technical matter is:

Multi-level waterway control device, comprises:

A fixed unit;

A flow regulating plate, which is rotationally arranged in the fixed unit, and flow regulation is achieved through the relative rotation between the flow regulating plate and the fixed unit;

A function switching plate, which is rotationally arranged in the fixed unit, and the outlet functions switch is achieved through the relative rotation between the function switching plate and the fixed unit;

And a drive unit, which forms a sliding and rotation connection relationship with the fixed unit, and the sliding can at least happen between the first position and the second position;

And wherein:

When the drive unit is at the first position, the drive unit can form a synchronous rotation connection relationship with the flow regulating plate, and can form a relative free rotation connection relationship with the function switching plate;

When the drive unit is at the second position, the drive unit can form a synchronous rotation connection relationship with the function switching plate, and can form a relative free rotation connection relationship with the flow regulating plate.

In a preferred embodiment,

The flow regulating plate is provided with a first inner hole, and an axial first synchronous slot is opened on the inner revolution surface of the first inner hole;

The function switching plate is provided with a second inner hole, and an axial second synchronous slot is opened on the inner revolution surface of the second inner hole;

A mounting slot is opened on the drive unit, an elastic body and the synchronous keys that can be against the elastic body and extend out of the mounting slot are mounted in the mounting slot, the synchronous keys can be adaptive to the first synchronous slot and the second synchronous slot;

Wherein, when the drive unit is at the first position, the synchronous keys are adaptive to the first synchronous slot, and when the drive unit is at the second position, the synchronous keys are adaptive to the second synchronous slot.

In a preferred embodiment, the flow regulating plate and the function switching plate are distributed along the sliding direction of the drive unit, the back two sides of the synchronous keys which are corresponding to the flow regulating plate and the function switching plate respectively are arranged to be oblique guiding surface respectively.

In a preferred embodiment, the flow regulating plate and the function switching plate are distributed along the sliding direction of the drive unit, a convex ring is convexly formed at the lower end of the first inner hole of the flow regulating plate, the back two sides of the convex ring are arranged to be oblique guiding surface respectively.

In a preferred embodiment, the mounting slot is a penetrating slot, and a synchronous key is arranged at each of the two ends of the elastic body respectively.

In a preferred embodiment, the fixed unit is provided with multiple outlet functions, and each of the outlet functions is provided with a water division hole, and the water division holes are arranged in a circular form; the function switching plate is hermetically and rotationally connected to the fixed unit, a penetrating outlet hole is opened on the function switching plate; the communication of the water division holes and the outlet hole is switched through the relative rotation between the function switching plate and the fixed unit.

In a preferred embodiment, the fixed unit is provided with a water passing hole, a penetrating adjusting hole is opened on the flow regulating plate, the width of the adjusting hole is changed along the curve according to the rotary axis; the overlap area between the adjusting hole and the water passing hole is regulated through the relative rotation between the flow regulating plate and the fixed unit to regulate the flow.

In a preferred embodiment, an adjusting hole is opened on the flow regulating plate, an outlet hole is opened on the function switching plate, and the adjusting hole can communicate with the outside water resource, and the outlet hole can communicate with the adjusting hole.

In a preferred embodiment, the fixed unit also comprises a fixed plate which is arranged between the flow regulating plate and the function switching plate and is provided with a penetrating hole;

The diameters of the first inner hole of the flow regulating plate and the second inner hole of the function switching plate are equal, and the flow regulating plate is joined to the function switching plate, and the joint is in the penetrating hole.

Compared with the technical proposal at the prior, the benefits of the present invention are:

Synchronous connection of the flow regulating plate and the function switching plate is chosen according the position where the drive unit is, the flow regulating plate can be driven to rotate to achieve flow regulation when the drive unit is at the first position, the function switching plate can be driven to rotate to achieve outlet functions switch when the drive unit is at the second position, so that a drive unit can achieve at least two functions with simple structure, easy operation, low cost of water resource, powerful regulating function and small space occupation, and it can be used in handheld shower, and can achieve self-locking without additional locating mechanism;

An elastic body is arranged between the control teeth and the drive unit, which ensures that the drive unit can slide between the first position and the second position and ensures that the synchronous connection of the flow regulating plate and the function switching plate can be chosen by the drive unit with low force application of users and convenient operation;

The mounting slot is a penetrating slot, each of the two ends of the elastic body is connected with a synchronous key respectively with stable and even tolerance, and the clutch mechanism is stable, and it is easy to assemble;

The width of the adjusting hole is changed to reduce along the curve according to the rotary axis, the overlap area between the adjusting hole and the water passing hole is regulated through the relative rotation between the flow regulating plate and the fixed unit to regulate the flow, the structure is simple, and can achieve multi-level flow regulation;

The adjusting hole is communicated with outside water resource, and the outlet hole is communicated with the adjusting hole, so that the flow regulation of all the outlet functions can be achieved;

The back two sides of the synchronous keys are arranged to be oblique guiding surface respectively, which can ensure that the drive unit can freely slide between the first position and the second position, preventing the synchronous keys from blocking the sliding of the drive unit;

A convex ring is convexly formed at the lower end of the first inner hole of the flow regulating plate, the back two sides of the convex ring are arranged to be oblique guiding surface respectively, which can ensure that the drive unit can freely slide between the first position and the second position, preventing the synchronous keys from blocking the sliding of the drive unit;

A convex ring is convexly formed at the lower end of the first inner hole of the flow regulating plate, the diameter of the convex ring is shorter than the diameters of the first inner hole of the flow regulating plate and the second inner hole of the function switching plate, which can ensure that the drive unit can be located at the first position and the second position, and ensure that the drive unit can slide coupling with the oblique guiding surface.

REFERENCE SIGNS

Figure 1:
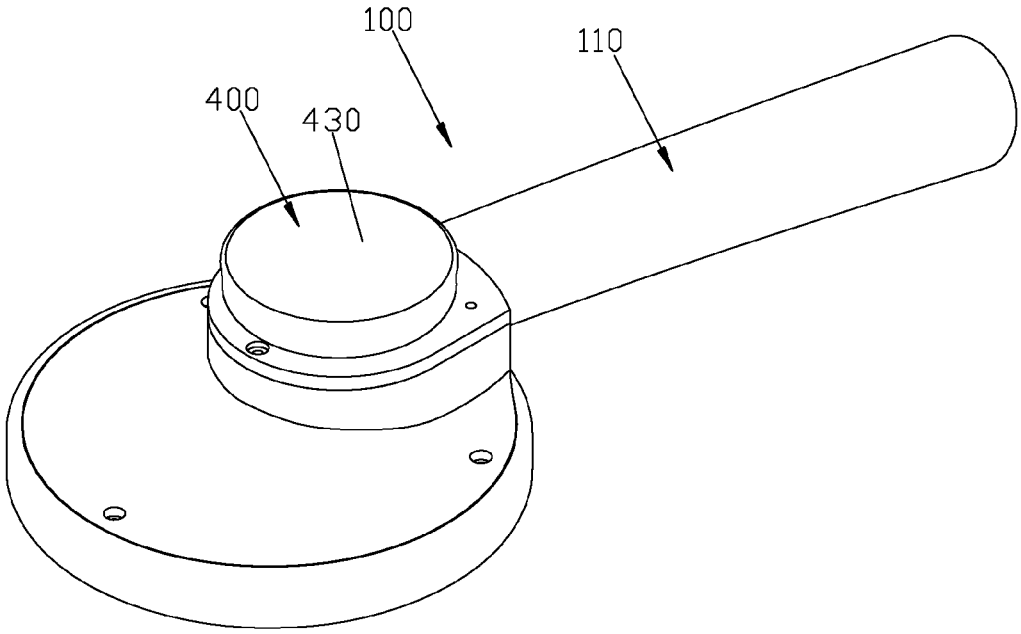
FIG. 1 shows the solid abridged general view of the hand held shower of one preferred embodiment.

Fixed unit 100, flow regulating plate 200, function switching plate 300, drive unit 400, fixed plate 500, body 110, face cover 120, close cover 130, hollow hole 113, containing slot 112, water division hole 140, second inner hole 310, first synchronous slot 311, outlet hole 320, water passing hole 510, penetrating hole 520, first inner hole 210, second synchronous slot 211, adjusting hole 220, rotary shaft 410, rotary part 420, knob 430, mounting slot 421, elastic body 422, synchronous key 423.

DESCRIPTION OF THE PREFERRED EMBODIMENTS

With the following description of the drawings and specific embodiments, the invention shall be further described in details.

Figure 2:
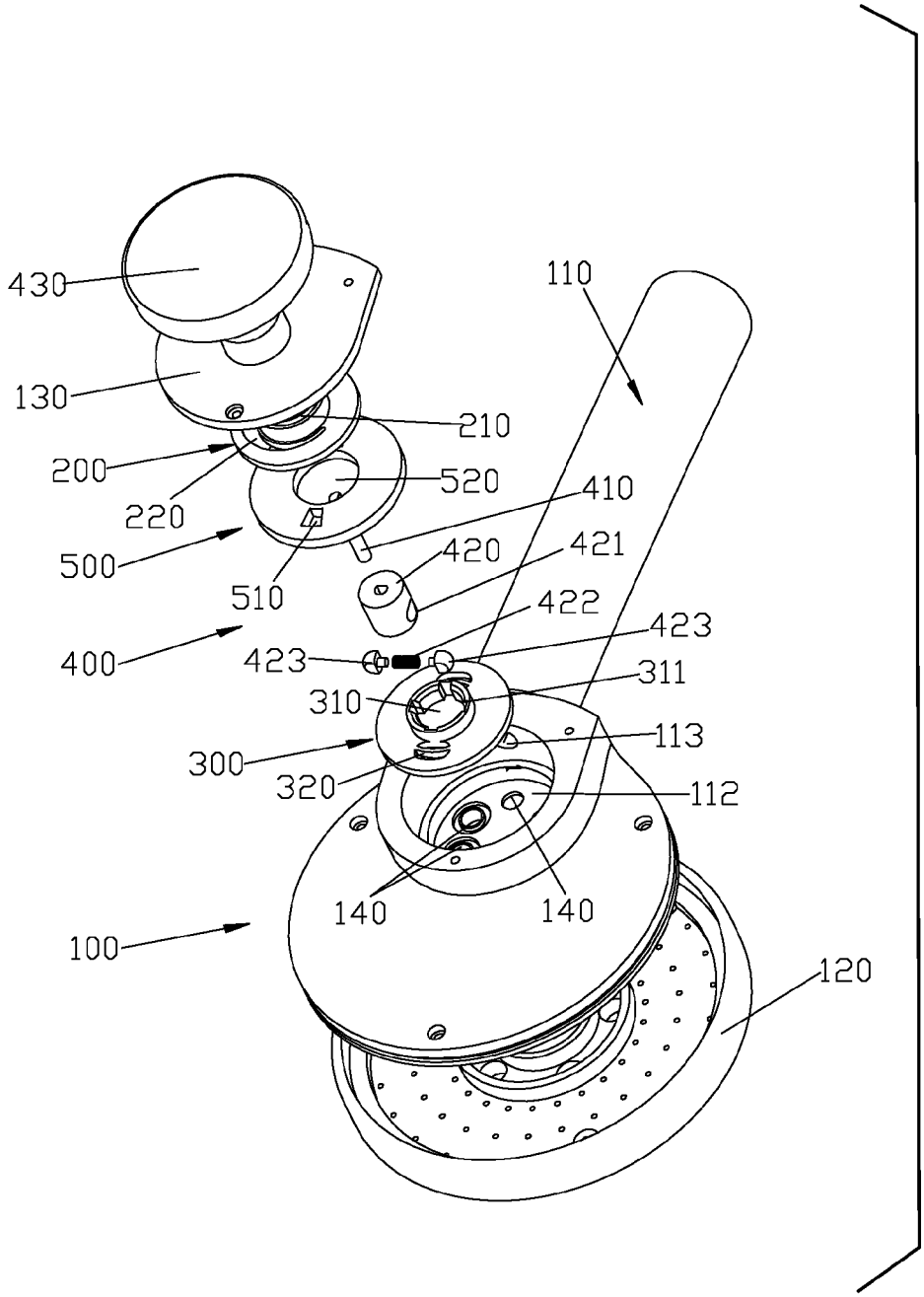
FIG. 2 shows the first solid exploded view of the hand held shower of one preferred embodiment.
Figure 3:
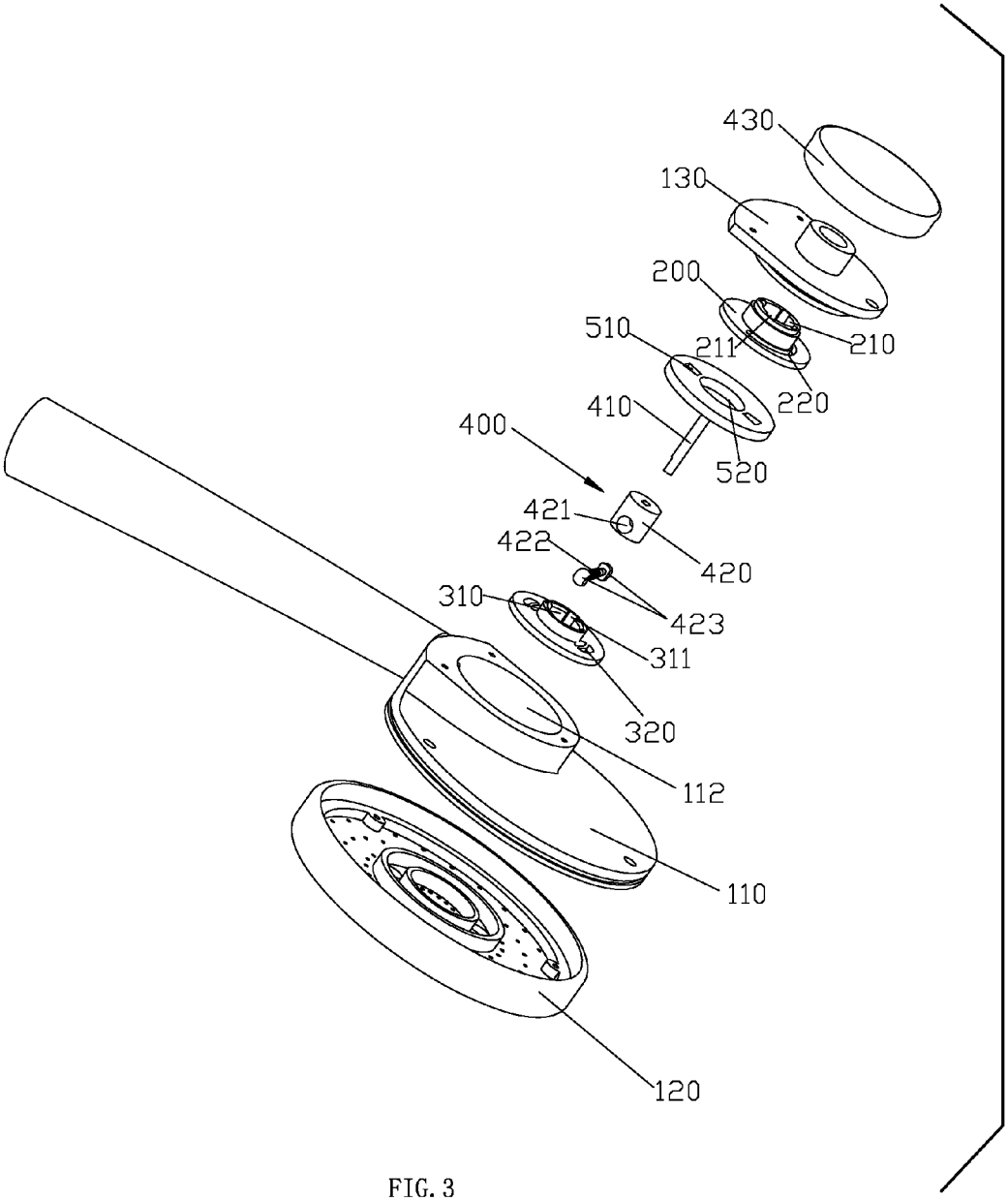
FIG. 3 shows the second solid exploded view of the hand held shower of one preferred embodiment.

According to FIGS. 1, 2 and 3, in the present embodiment, the multi-level waterway control device can be a handheld shower, which it is not limited, or can be directly used in the waterway control valve. The multi-level waterway control device comprises a fixed unit 100, a flow regulating plate 200, a function switching plate 300, a drive unit 400 and a fixed plate 500.

According FIG. 1 to 3, FIG. 8 to 14, the fixed unit 100 comprises a body 110, a face cover 120 and a close cover 130. The body 110 comprises a handle and a connector fixed to the handle; the handle is hollow to form the hollow hole 113 and can be communicated with outside water resource through the plug; a cylindrical containing slot 112 is downward concavely formed by the connector, and is communicated with the hollow hole of the handle, and the containing slot 112 is a large small step hole. The face cover 120 is fixedly connected under the body 110 with three outlet functions, each outlet function is provided with one group of the water division holes 140 (each group of the water division holes 140 is better to comprises two water division holes arranged symmetrically), the water division holes 140 are arranged on the button surface of the containing slot 112 in a circular form. The close cover 130 is hermetically and fixedly connected to the top open of the containing slot 112.

Figure 4:
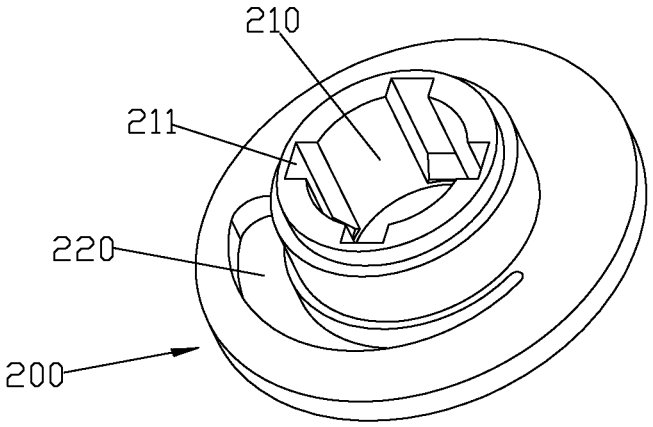
FIG. 4 shows the abridged general view of the flow regulating plate of the hand held shower of one preferred embodiment.
Figure 5:
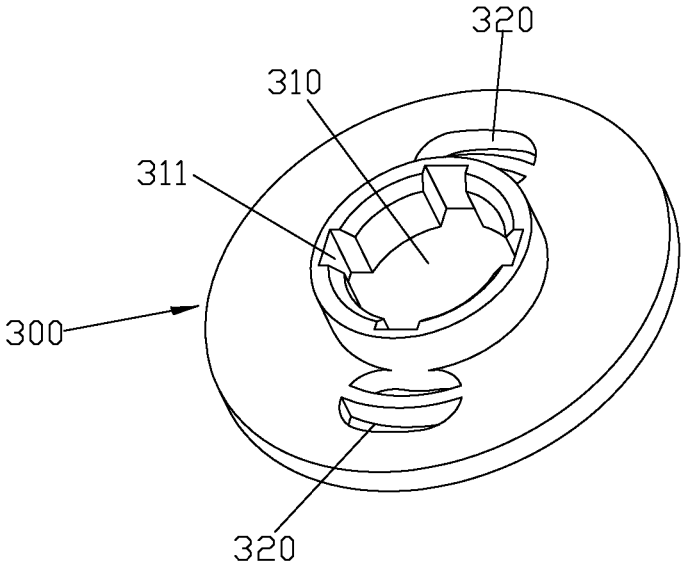
FIG. 5 shows the abridged general view of the function switching plate of the hand held shower of one preferred embodiment.

According to FIG. 5, the function switching plate 300 is provided with a circular switching plate body and a switching surrounding wall fixedly arranged in the switching plate body, a second inner hole 310 penetrating up and down is opened in the function switching plate 300, four vertical second synchronous slots 311 that are in circular arrangement are concavely arranged on the revolution surface of the second inner hole 310; a group of outlet holes 320 penetrating up and down are symmetrically opened on the switching plate body of the switching plate 300 (each group is better to comprises two symmetrically arranged outlet holes). According to FIG. 1 to FIG. 14, the function switching plate 300 is rotationally arranged in the containing slot 112 of the body 110, the function switching plate 300 is hermetically and rotationally mounted on the bottom surface of the containing slot 112, the outlet hole 320 of the function switching plate 300 is corresponding to the water division hole 140, and the communication between the water division hole 140 and the outlet hole 320 can be switched through the relative rotation between the function switching plate 300 and the fixed unit 100.

According to FIG. 1 to FIG. 14, the fixed plate 500 is fixedly supported on the step surface of the step hole of the containing slot 112 of the fixed unit 100 to be hermetically fixedly mounted in the containing slot 112, a penetrating hole 520 penetrating up and down and a group of water passing holes 510 penetrating up and down are opened in the fixed plate 500, the switching surrounding wall of the function switching plate 300 is sleeved in the penetrating hole 520. An outlet cavity is formed among the switching plate 300, the fixed plate 500 and the surrounding wall of the containing slot 112, so that the lower end of the water passing hole 510 can be communicated with the outlet hole 320 of the function switching plate 300. As needed, a spring can be arranged between the fixed plate 500 and the function switching plate to ensure that the function switching plate can be hermetically mounted to the bottom surface of the containing slot 112.

According to FIG. 4, the flow regulating plate 200 is provided with a circular regulating plate body, a regulating surrounding wall fixedly arranged on the regulating plate body and a locating surrounding wall fixedly connected under the regulating plate body, a first inner hole 210 penetrating up and down is opened in the flow regulating plate 200, four first synchronous slot 211 arranged in circular form are concavely arranged on the revolution surface of the first inner hole 210; a adjusting hole 220 penetrating up and down is opened in the adjusting plate body of the flow regulating plate 200, the width of the adjusting hole 220 is changed to reduce along the curve according to the rotary axis, and to form a whole body, and stepless regulation is achieved. A convex ring 888 is convexly formed at the lower end of the flow regulating plate 200. According to FIG. 1 to FIG. 14 the flow regulating plate 200 is hermetically rotationally connected on the fixed plate 500, and, the locating surrounding wall is sleeved in the penetrating hole 520 of the fixed plate 500, the locating surrounding wall of the flow regulating plate is joined to the switching surrounding wall of the function switching plate, the adjusting hole 220 is corresponding to the water passing hole 510, the overlap area between the adjusting hole 220 and the water passing hole 510 is regulated through the relative rotation between the flow regulating plate 200 and the body 110 (fixed plate 500) of the fixed unit 100 to regulate the flow.

In the present embodiment, the waterway is along the outside water resource, the containing slot, the adjusting hole, the water passing hole, the outlet cavity, the outlet hole, the water division hole and the outlet function in turn.

Figure 6:
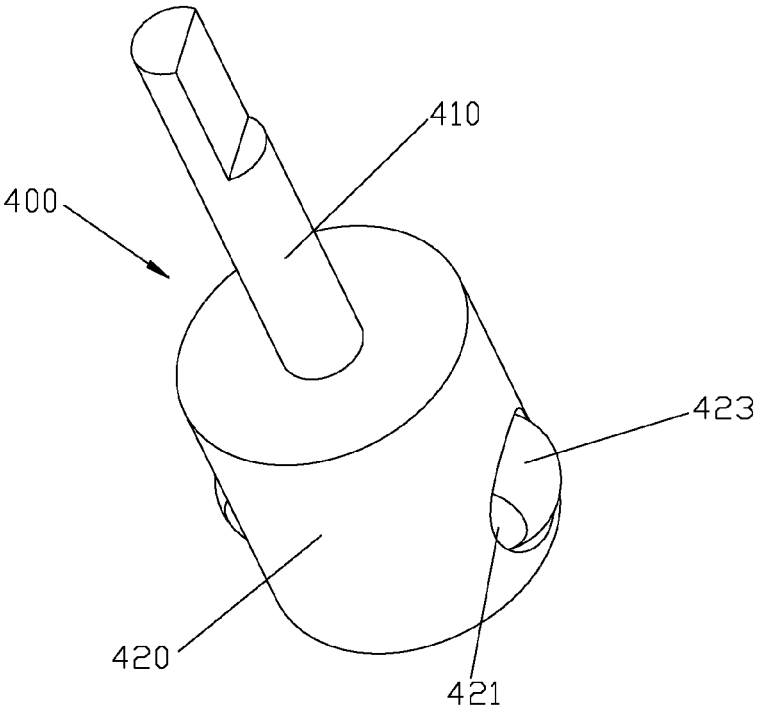
FIG. 6 shows the solid abridged general view of the drive unit of the hand held shower of one preferred embodiment.
Figure 7:
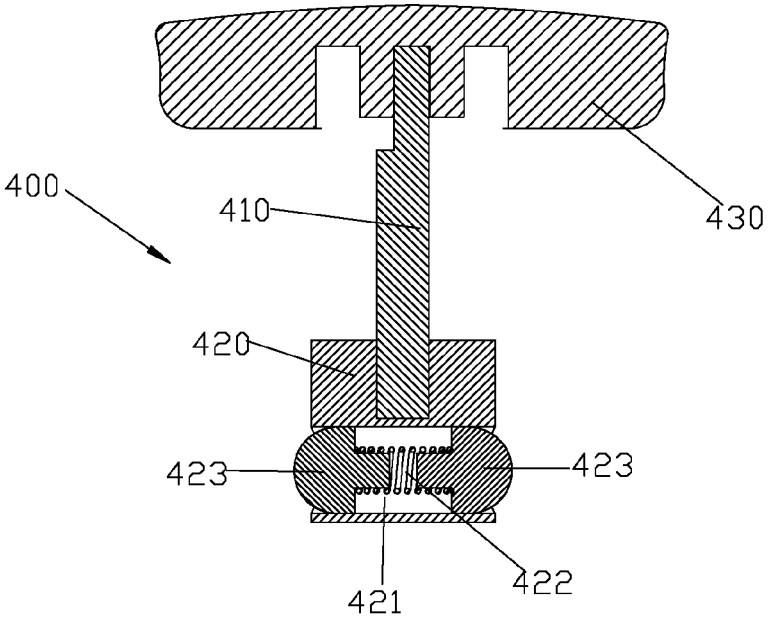
FIG. 7 shows the middle sectional view of the drive unit of the hand held shower of one preferred embodiment.
Figure 8:
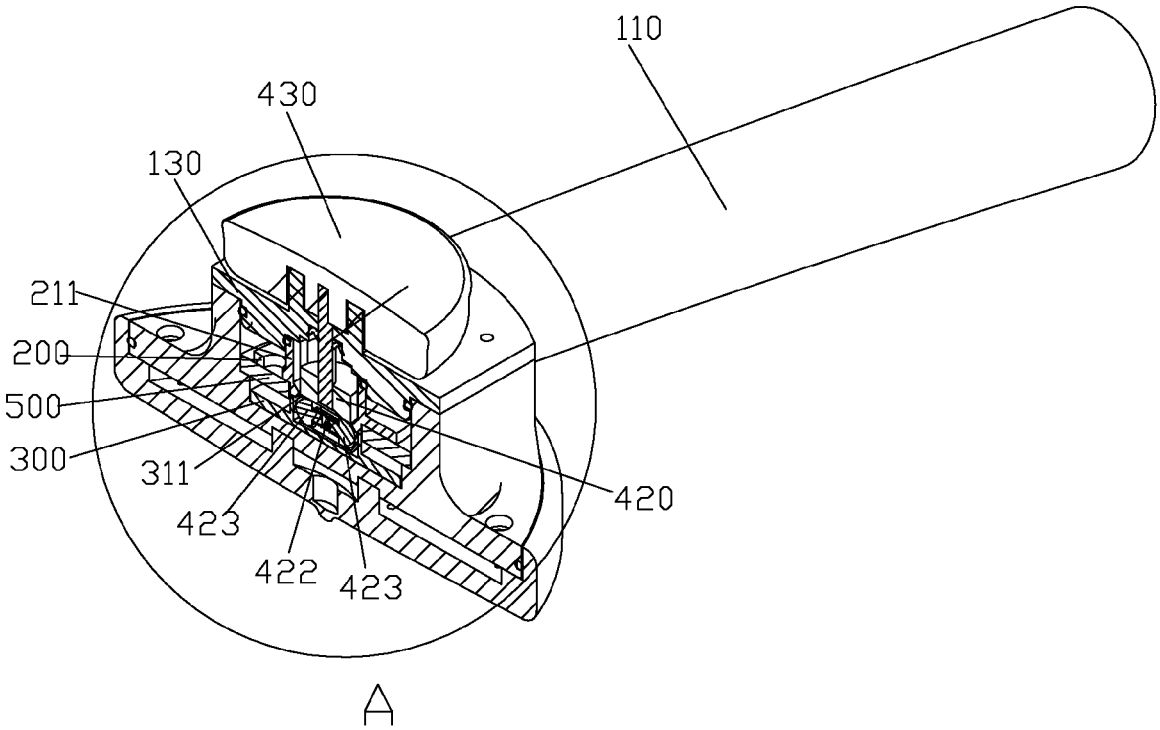
FIG. 8 shows the solid half sectional view of the hand held shower of one preferred embodiment.
Figure 9:
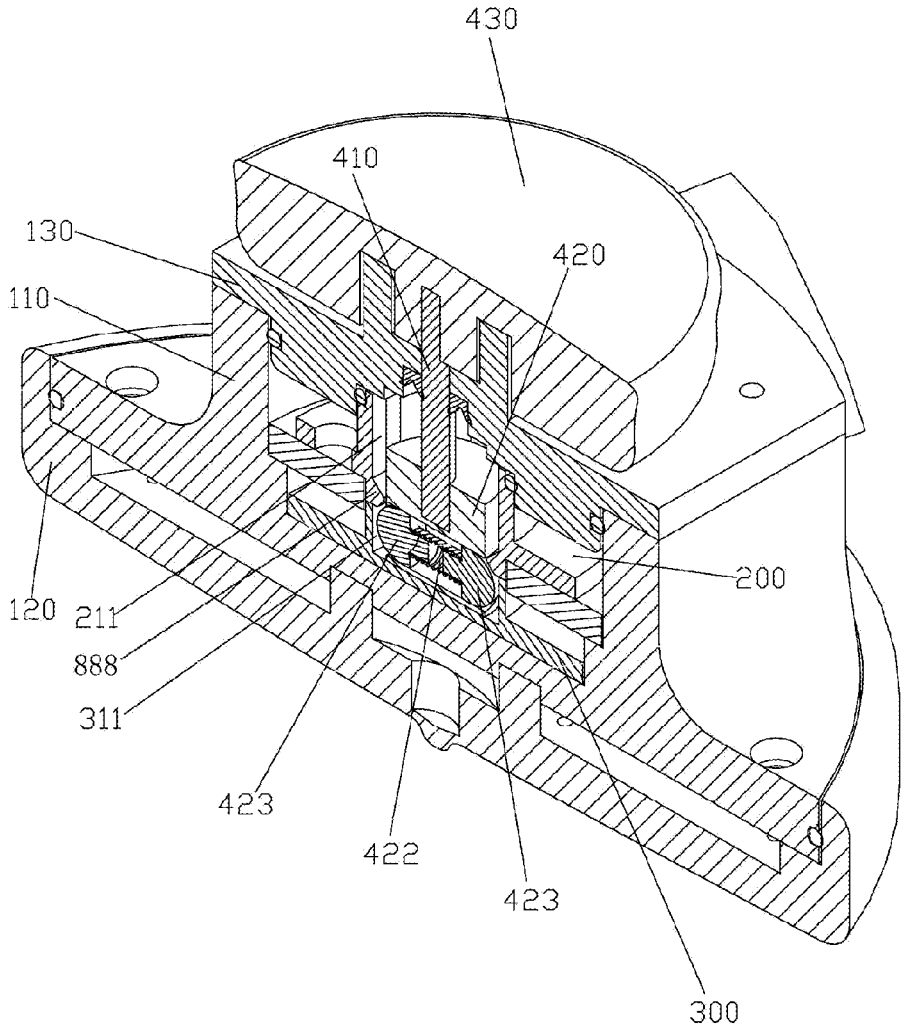
FIG. 9 shows the amplifying abridged general view of FIG. 8A.
Figure 10:
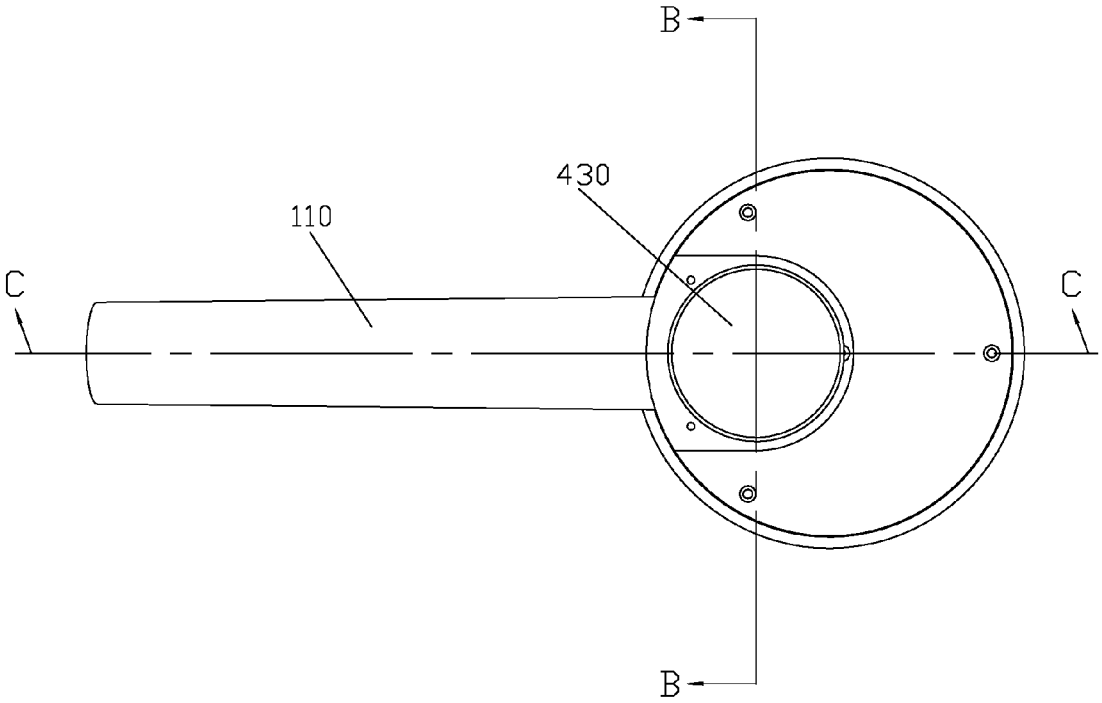
FIG. 10 shows the top view of the hand held shower of one preferred embodiment.

According to FIG. 6 and FIG. 7, the drive unit 400 comprises a rotary shaft 410, a rotary part 420 and a knob 430. A mounting slot that penetrating the diameter of the rotary part 420 is open in the rotary part 420, an elastic body 422 is mounted in the mounting slot 421, each end of the elastic body 422 is connected with a synchronous key 423, the synchronous key 423 is adaptive to the first synchronous slot 311 and the second synchronous slot 211. According to FIG. 8 to FIG. 14, the rotary part 420 can be rotationally connected at the first inner hole 210 of the flow regulating plate 200, the second inner hole 310 of the function switching plate 300 and the penetrating hole 520 of the fixed plate 500, and can slide relative to the first inner hole 210 of the flow regulating plate 200, the second inner hole 310 of the function switching plate 300 and the penetrating hole 520 of the fixed plate 500, namely can slide and rotate relative to the fixed unit 100. The sliding can at least happen between the first position and the second position. One end of the rotary shaft 410 is fixedly connected to the rotary part 420, anther end rotationally runs through the close cover 130; the knob 430 is fixed to the running-through end of the rotary shaft 410.

Figure 11:
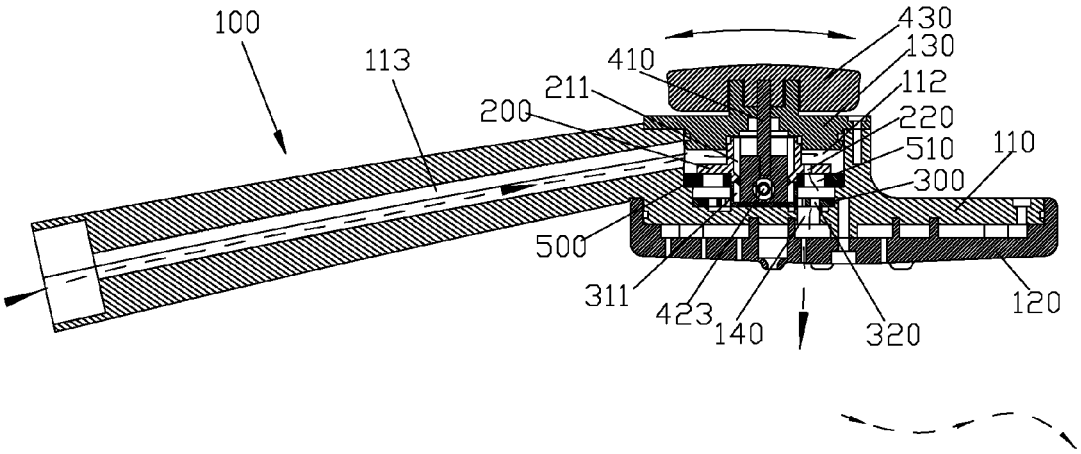
FIG. 11 shows the sectional view of FIG. 10 C-C, the drive unit of the hand held shower is at the second position at the moment.
Figure 12:
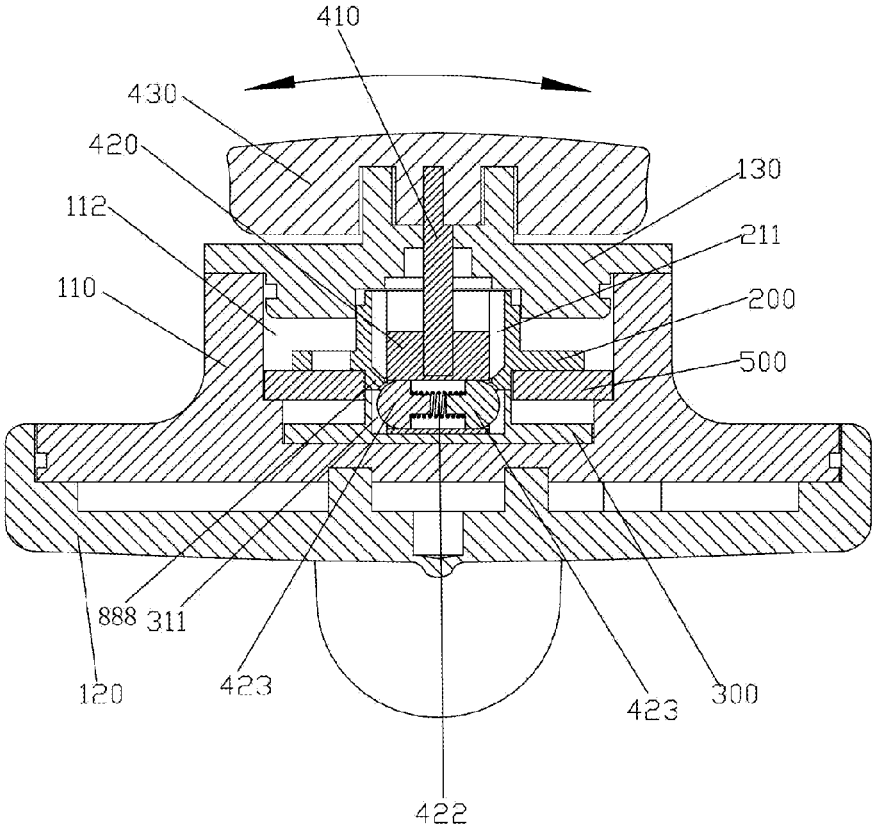
FIG. 12 shows the sectional view of FIG. 10 B-B, the drive unit of the hand held shower is at the second position at the moment.
Figure 13:
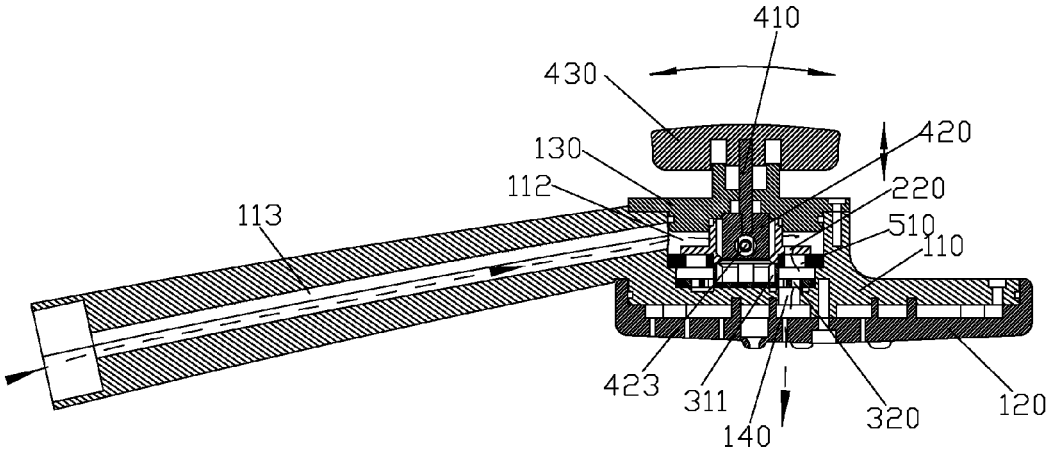
FIG. 13 shows the sectional view of FIG. 10 C-C, the drive unit of the hand held shower is at the first position at the moment.
Figure 14:
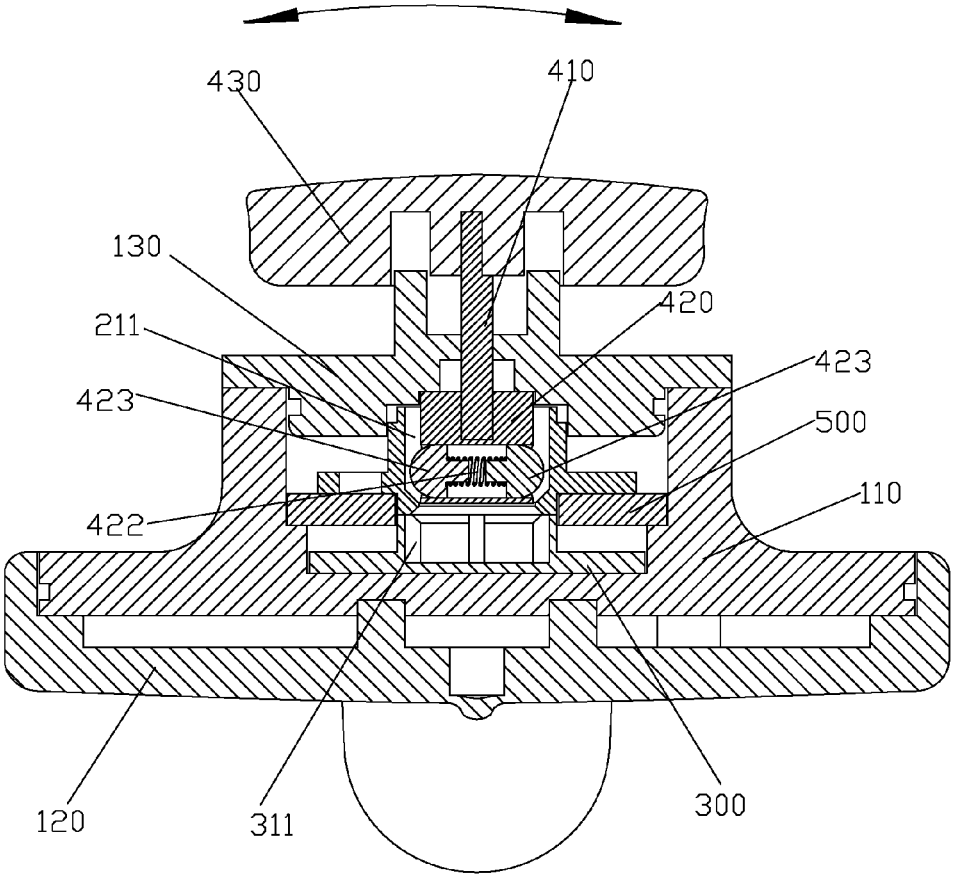
FIG. 14 shows the sectional view of FIG. 10 B-B, the drive unit of the hand held shower is at the first position at the moment.

When the drive unit 400 is at the first position, the synchronous key 423 is adaptive to the first synchronous slot 211 of the flow regulating plate 200, and forms a relative free rotation connection relationship with the function switching plate 300, and forms a synchronous rotation connection relationship with the flow regulating plate 200, when the knob 430 is turned, the flow regulating plate 200 can rotate relative to the fixed unit 100 through the synchronous key 423 to achieve flow regulation with reference of FIG. 11 and FIG. 12;

When the drive unit 400 is at the second position, the synchronous key 423 is adaptive to the second synchronous slot 311 of the function switching plate 300, and forms a synchronous rotation connection relationship with the function switching plate 300, and forms a relative free rotation connection relationship with the flow regulating plate 200, when the knob 430 is turned, the function switching plate 423 can rotate relative to the fixed unit 100 through the synchronous key 423 to achieve outlet function switch with reference of FIG. 8, FIG. 9, FIG. 13 and FIG. 14.

Wherein, the length of the synchronous key 423 is not longer than the vertical distance of the first synchronous slot, and is not longer than the vertical distance of the second synchronous slot.

To ensure the locating of the drive unit 400 between the first position and the second position, it is better that the diameters of the first inner hole 210 of the flow regulating plate 200 and the second inner hole 310 of the function switching plate 300 are equal.

To ensure the sliding of the drive unit 400 between the first position and the second position and choking (compressing the elastic body) of the synchronous key 423 to pass the convex ring 888 of the fixed plate 500 (when the elastic body is compressed, the maximum distance between the two synchronous keys is shorter than the inner diameter of the convex ring 888, when the elastic body is loosen, the maximum distance between the two synchronous keys is not shorter than the inner diameter of the convex ring 888), it is better that the back upside and the back downside of the synchronous key 423 are arranged to be oblique guiding surface, and the two back sides of the convex ring 888 are arranged to be oblique guiding surface.

The drive unit 400 is slided by the users, for example, from the first position to the second position.

When it is at the first position, the synchronous key 423 is adaptive to the first synchronous slot 211 of the flow regulating plate 200 to form a synchronous rotation connection relationship, and the rotation of the drive unit can be driven by turning the knob, and the flow regulating plate can be driven by the synchronous key to achieve outlet flow regulation.

The users operate the knob to move the drive unit 400 from the first position to the second position, the oblique guiding surface of the synchronous 423 interacts with the oblique guiding surface of the convex ring 888 and compresses the elastic body 422 when sliding, so that the synchronous key 423 is choked and can pass through the inner revolution surface of the convex ring 888; the synchronous key 423 is located in the second inner hole 310 of the function switching plate 300, and the drive unit 400 is rotated to make synchronous key 423 adaptively enter the second synchronous slot 311 to form a synchronous rotation connection relationship (assuming that the synchronous key 423 just enters the second synchronous slot, the synchronous rotation connection relationship can be formed without the rotation of the drive unit), and the rotation of the drive unit can be driven by the rotation of the knob at this moment, and rotation of the function switching plate can be driven by the synchronous key to achieve outlet functions switch.

In the present embodiment, the control is two-level control, namely the drive unit is located at two positions, and the two levels are corresponding to functions switch and the flow regulation respectively, but it is not limited. As needed, it can also be arranged to be three-level, such as the first function switch, the second function switch and the flow regulation, or, the function switch, the first flow regulation and the second flow regulation.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

The multi-level waterway control device in the present invention can achieve flow regulation through the relative rotation between the flow regulating plate and the fixed unit, and can achieve outlet functions switch through the relative rotation between the function switching plate and the fixed unit. The structure of the present invention is simple, and the operation is convenient, and the present invention is provided with good industrial applicability.

What is claimed is:

1. A multi-level waterway control device, comprising:

a fixed unit;

a flow regulating plate rotationally arranged in the fixed unit, flow regulation being achieved through a relative rotation between the flow regulating plate and the fixed unit, the flow regulating plate having a first inner hole, and an axial first synchronous slot opened on an inner revolution surface of the first inner hole;

a function switching plate rotationally arranged in the fixed unit, switching between a plurality of outlet functions is achieved through a relative rotation between the function switching plate and the fixed unit, the function switching plate having a second inner hole, and an axial second synchronous slot opened on an inner revolution surface of the second inner hole; and a drive unit having a sliding and rotation connection relationship with the fixed unit, the sliding occurring at least between a first position of the drive unit and a second position of the drive unit, the drive unit having an open mounting slot, an elastic body and synchronous keys, the elastic body and synchronous keys being mounted in the mounting slot, the synchronous keys being against the elastic body and extending out of the mounting slot, the synchronous keys being adaptive to the first synchronous slot and the second synchronous slot;

wherein when the drive unit is at the first position, the drive unit has a synchronous rotation connection relationship with the flow regulating plate, and has a relative free rotation connection relationship with the function switching plate;

when the drive unit is at the second position, the drive unit has a synchronous rotation connection relationship with the function switching plate, and has a relative free rotation connection relationship with the flow regulating plate; and when the drive unit is at the first position, the synchronous keys are adaptive to the first synchronous slot, and when the drive unit is at the second position, the synchronous keys are adaptive to the second synchronous slot.

2. The multi-level waterway control device according to claim 1, wherein the flow regulating plate and the function switching plate are distributed along a sliding direction of the drive unit, the synchronous keys having back sides which correspond to the flow regulating plate and the function switching plate respectively, and being arranged to be oblique guiding surface, respectively.

3. The multi-level waterway control device according to claim 1, wherein the flow regulating plate and the function switching plate are distributed along a sliding direction of the drive unit, a convex ring being convexly formed at a lower end of the first inner hole of the flow regulating plate, the convex ring having two back sides arranged to be oblique guiding surfaces, respectively.

4. The multi-level waterway control device according to claim 1, wherein the mounting slot is a penetrating slot, and the synchronous keys are arranged at each of two ends of the elastic body, respectively.

5. The multi-level waterway control device according to claim 1, wherein the fixed unit has multiple outlet functions, each of the outlet functions having a water division hole, the water division holes being arranged in a circular form; the function switching plate being hermetically and rotationally connected to the fixed unit, a penetrating outlet hole being opened on the function switching plate; communication of the water division holes and the penetrating outlet hole being switched through the relative rotation between the function switching plate and the fixed unit.

6. The multi-level waterway control device according to claim 1, wherein the fixed unit has a water passing hole, the flow regulating plate has an opened penetrating adjusting hole, a width of the penetrating adjusting hole changing along a curve according to a rotary axis; an overlap area between the penetrating adjusting hole and the water passing hole being regulated through the relative rotation between the flow regulating plate and the fixed unit to regulate a flow.

7. The multi-level waterway control device according to claim 1, wherein the flow regulating plate has an opened adjusting hole, and the function switching plate has an opened outlet hole, the adjusting hole communicating with an outside water source, and the outlet hole communicating with the adjusting hole.

8. The multi-level waterway control device according to claim 1, wherein, the fixed unit also comprises a fixed plate which is arranged between the flow regulating plate and the function switching plate and is provided with a penetrating hole;

a diameter of the first inner hole of the flow regulating plate and a diameter of the second inner hole of the function switching plate being equal, the flow regulating plate being joined to the function switching plate at a joint, with the joint being in the penetrating hole.

9. The multi-level waterway control device according to claim 2, wherein the fixed unit has multiple outlet functions, each of the outlet functions having a water division hole, the water division holes being arranged in a circular form; the function switching plate being hermetically and rotationally connected to the fixed unit, a penetrating outlet hole being opened on the function switching plate; communication of the water division holes and the penetrating outlet hole being switched through the relative rotation between the function switching plate and the fixed unit.

10. The multi-level waterway control device according to claim 3, wherein the fixed unit has multiple outlet functions, each of the outlet functions having with a water division hole, the water division holes being arranged in a circular form; the function switching plate being hermetically and rotationally connected to the fixed unit, a penetrating outlet hole being opened on the function switching plate; communication of the water division holes and the penetrating outlet hole being switched through the relative rotation between the function switching plate and the fixed unit.

11. The multi-level waterway control device according to claim 4, wherein the fixed unit has multiple outlet functions, each of the outlet functions having a water division hole, the water division holes being arranged in a circular form; the function switching plate being hermetically and rotationally connected to the fixed unit, a penetrating outlet hole being opened on the function switching plate; communication of the water division holes and the penetrating outlet hole being switched through the relative rotation between the function switching plate and the fixed unit.

12. The multi-level waterway control device according to claim 2, wherein the fixed unit has a water passing hole, the flow regulating plate has an opened penetrating adjusting hole, a width of the penetrating adjusting hole changing along a curve according to a rotary axis; an overlap area between the penetrating adjusting hole and the water passing hole being regulated through the relative rotation between the flow regulating plate and the fixed unit to regulate a flow.

13. The multi-level waterway control device according to claim 2, wherein, the fixed unit also comprises a fixed plate which is arranged between the flow regulating plate and the function switching plate and is provided with a penetrating hole;

a diameter of the first inner hole of the flow regulating plate and a diameter of the second inner hole of the function switching plate being equal, the flow regulating plate being joined to the function switching plate at a joint, with the joint being in the penetrating hole.

14. The multi-level waterway control device according to claim 3, wherein, the fixed unit also comprises a fixed plate which is arranged between the flow regulating plate and the function switching plate and is provided with a penetrating hole;

a diameter of the first inner hole of the flow regulating plate and a diameter of the second inner hole of the function switching plate being equal, the flow regulating plate being joined to the function switching plate at a joint, with the joint being in the penetrating hole.

15. The multi-level waterway control device according to claim 4, wherein, the fixed unit also comprises a fixed plate which is arranged between the flow regulating plate and the function switching plate and is provided with a penetrating hole;

a diameter of the first inner hole of the flow regulating plate and a diameter of the second inner hole of the function switching plate being equal, the flow regulating plate being joined to the function switching plate at a joint, with the joint being in the penetrating hole.

* * * * *